US007950090B2

(12) United States Patent
Tsui et al.

(10) Patent No.: US 7,950,090 B2
(45) Date of Patent: May 31, 2011

(54) ARTICLE AND METHOD FOR DISTRESS-WASHING FABRIC

(75) Inventors: Kat Tsui, Hong Kong (CN); Eric Chi Shun Lee, Charlotte, NC (US)

(73) Assignee: Man Fung Technologies, Inc., Charlotte, NC (US)

( * ) Notice: Subject to any disclaimer, the term of this patent is extended or adjusted under 35 U.S.C. 154(b) by 207 days.

(21) Appl. No.: 12/349,610

(22) Filed: Jan. 7, 2009

(65) Prior Publication Data

US 2010/0170047 A1 Jul. 8, 2010

(51) Int. Cl.
*D06B 23/00* (2006.01)

(52) U.S. Cl. ..... 8/159; 68/29; 68/30

(58) Field of Classification Search ..... 68/29, 30; 451/330

See application file for complete search history.

(56) References Cited

U.S. PATENT DOCUMENTS

| | | | | | |
|---|---|---|---|---|---|
| 2,024,310 | A | * | 12/1935 | Sundback | 451/35 |
| 2,978,850 | A | * | 4/1961 | Gleszer | 451/35 |
| 3,102,011 | A | * | 8/1963 | Bellinger | 51/298 |
| 4,381,188 | A | * | 4/1983 | Waizer et al. | 51/298 |
| 4,736,547 | A | * | 4/1988 | Bond et al. | 451/330 |
| 4,750,227 | A | * | 6/1988 | Hopkins et al. | 8/158 |
| 4,765,100 | A | * | 8/1988 | Majors | 451/32 |
| 5,093,948 | A | * | 3/1992 | Val et al. | 8/159 |
| 5,245,722 | A | * | 9/1993 | Dameron | 8/158 |
| 5,601,475 | A | * | 2/1997 | Stametz et al. | 451/35 |
| 5,653,625 | A | * | 8/1997 | Pierce et al. | 451/326 |
| 5,730,645 | A | * | 3/1998 | Park | 451/32 |
| 6,165,059 | A | * | 12/2000 | Park | 451/330 |

FOREIGN PATENT DOCUMENTS

DE 38 21 175 * 12/1989

OTHER PUBLICATIONS

European Patent Office 0 033 562 Aug. 1981.*

* cited by examiner

*Primary Examiner* — Frankie L Stinson
(74) *Attorney, Agent, or Firm* — Oliff & Berridge, PLC

(57) ABSTRACT

An article for distress-washing fabric comprising a hollow float and at least one distressing feature projecting outwardly from an outer surface of the float, wherein the article is substantially wear resistant and does not produce residue as a result of impact with fabric, internal surfaces of a washing machine and additional articles for distress-washing fabric. A method for distress-washing fabric utilizing an article described herein.

7 Claims, 4 Drawing Sheets

ARTICLE AND METHOD FOR DISTRESS-WASHING FABRIC

TECHNICAL FIELD AND BACKGROUND OF THE INVENTION

The present invention relates generally to the field of articles and methods for distress-washing fabrics.

Distress-washing fabric, also commonly referred to in the industry as "stone washing," is a textiles manufacturing process whereby new cloth garments are tumbled in an industrial clothes washer with stones or other articles to give the garments a worn appearance. During the process, as the wash cylinder rotates about a horizontal axis, the stones repeatedly impact the cloth fibers as the stones and garments tumble inside the drum. While stone washing is an effective process to produce a faded, worn appearance, the process can also be used to increase the softness and flexibility of otherwise stiff and rigid fabrics, such as canvas and denim.

Current methods for distress-washing fabrics, such as denim jeans, include tumbling the garments in an industrial washer with water and pumice stones. As known to those skilled in the art, pumice is a desirable choice for distressing fabrics due to its high-porosity and low-density, which makes it an excellent abrasive and allows it to float in the washer. However, there are several disadvantages to using pumice, such as the durability of the stones over time and the grit and sludge produced as the stones are ground away. Specifically, as the pumice stones are tumbled within the washer, they contact one another, the internal surfaces of the machine and the fabric, and are ground away. This results in not only stones having to be replaced, but also requires that the grit and sludge be removed from both the washer and from embedded in the fabric, requiring additional processing steps.

To overcome the disadvantages of using pumice to distress fabric, alternative distressing articles have been developed including chemical treatments, resin articles defining a rough surface, and perlite sand, among others. While chemical treatments may achieve a specific effect, they typically are not able to adequately duplicate the effects of mechanical distressing. As for resin balls, although they tend to have more mass than pumice and are more durable, they still are not ideal for mechanical distressing. As for perlite sand, while it is light, porous, sterile and chemically neutral, perlite is like pumice in that it produces grit during the distressing process that must be removed from the washer and fabric.

Accordingly, what is desired is an article for distress-washing fabric that overcomes the disadvantages of the prior art articles. A desirable article would be capable of producing the desired amount of distress during processing in an industrial washer, while at the same time being extremely durable, chemically neutral and environmentally friendly. Further, a desirable distressing article would not wear away upon impact with other articles or the machine, and thus would not produce grit or sludge, obviating the need for additional processing steps.

BRIEF SUMMARY OF THE INVENTION

In one aspect, the present invention provides various articles for distress-washing fabric.

In another aspect, the present invention provides a method for distress-washing fabric utilizing the articles described herein.

In yet another aspect, a distress-washing article is provided that is reusable, buoyant, chemically-neutral, has no impact on the color of the fabric, and is resistant to wearing away upon impact, facilitating distress-washing in fewer processing steps than with conventional articles.

In yet another aspect, an environmentally friendly distress-washing article and method is provided.

In yet another aspect, a hollow article is provided having sufficient mass to distress fabric upon impact with the fabric during a distressing process.

In yet another aspect, an article is provided including at least one distressing ring supported by a hollow float.

In yet another aspect, an article is provided including a hollow float defining at least one distressing feature on its outer surface.

In yet another aspect, a method of distress-washing fabric is provided utilizing a plurality of articles provided herein.

To achieve the foregoing and other aspects and advantages, articles for distress-washing fabric are provided including a hollow float and at least one distressing feature projecting outwardly from an outer surface of the float, wherein the article is substantially wear resistant and does not produce residue as a result of impact with fabric, internal surfaces of a washing machine and additional articles for distress-washing fabric. The at least one distressing feature includes at least one of at least one band that encircles the hollow float, a pair of bands secured together to form a cage in which the hollow float is maintained, a plurality of projections disposed either randomly or in a pattern on the outer surface of the hollow float, and a ridge.

The article may be made from stainless steel, ceramic, or ceramic coated stainless steel because of its durability, resistance to rust, and the lack of residue produced upon impact with other articles, the fabric and the internal surfaces of the washing machine.

In another embodiment, a method for distress-washing fabric is provided including the steps of: (a) providing an industrial washing machine, a fabric and at least one article for distress-washing fabric; (b) loading the machine with the fabric, the at least one article and water; and (c) tumbling the fabric and the at least one article at a predetermined speed and for a predetermined time such that the at least one article impacts the fabric to distress the fabric. The article of the method includes a hollow float and at least one distressing feature projecting outwardly from an outer surface of the float, wherein the article is substantially wear resistant and does not produce residue as a result of impact with fabric, internal surfaces of a washing machine and additional articles for distress-washing fabric. The distressing features includes at least one of a band, a plurality of bands, a projection and a ridge.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1A:
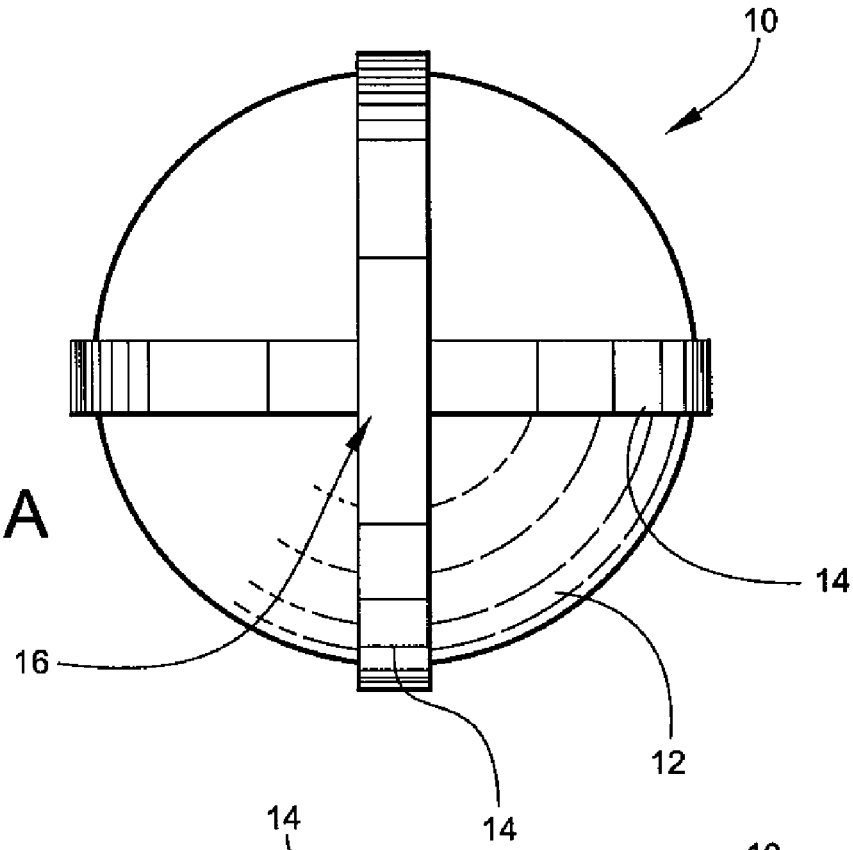
FIGS. 1A and 1B are perspective and cross-sectional views, respectively, of an article including at least one ring supported by a hollow float in accordance with an embodiment of the present invention.

Referring now to the drawings, wherein identical reference numerals denote the same elements throughout the drawings, articles and methods for distress-washing fabric are described with reference to various embodiments. The articles described herein may be utilized in any conventional industrial or commercial washing machine suitable for distress-washing fabric. Although not required, a preferable conventional washer would be one that rotates on a horizontal axis such that the articles and fabric "tumble" with gravity as the drum rotates, thus impacting the fabric. Throughout the specification and drawings, the various embodiments of articles for distress-washing fabric are generally spherically shaped, thus avoiding snagging and jamming with other articles and the washing machine. However, it is envisioned that the features described herein with respect to the articles may be applied to any shaped article chosen to produce a desired distressed effect in the fabric. Further, the term "article" as described and shown in the figures is not intended to denote any specific scale, mass or material, and the term may be used to refer to both integral and separate components. Articles may be constructed of any material including, but not limited to, stainless steel, other alloys and ceramics. Preferred materials are durable, rigid, do not give off residue, are resistant to rust and have sufficient mass to produce the desired impact.

Referring to FIG. 1, a first embodiment of an article for distress-washing fabric is shown at reference numeral 10. The article 10 is generally spherically shaped and includes a hollow ball 12, also referred to herein as a "float," maintained within a cage including at least one distressing feature, specifically a ring 14, that encircles the ball 10. As shown, the cage includes two rings 14 positioned about perpendicular with respect to one another with the ball 12 able to float therein. The rings 14 may be secured together at their intersections by any conventional method, such as spot welding or using fasteners. A disconnect between the ball and cage decreases the inertial mass of the article, thus decreasing the stress imparted on the fabric upon impact. Alternatively, the rings 14 may be welded or otherwise secured together and to the ball 12 to prevent the ball from rotating with respect to the rings, thus increasing the inertial mass of the article. The article may range in diameter from about less than one centimeter to about more than 8 cm, and is preferably about 5 cm. The ball portion of the article is hollow and sealed such that it contains a volume of air sufficient to overcome its mass and float within the machine. An exemplary weight is about 40 grams/article. The article 10 impacts the fabric during distress-washing to provide a worn appearance and soften the fabric.

Figure 1B:
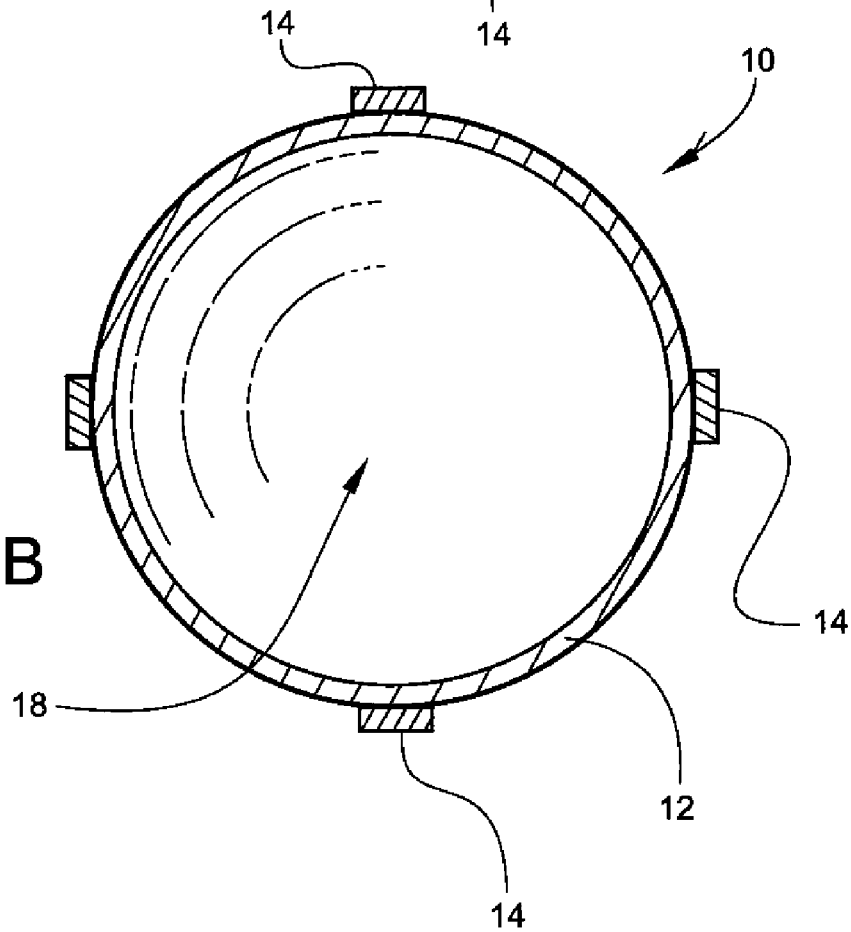

In one embodiment, the ball 12 is constructed from about 18-20 gauge stainless steel. The rings 14 may also be constructed from a similar gauge stainless steel. Stainless steel is advantageous in that it is resistant to rust and may be left in the washing machine between uses. Stainless steel is also durable, may be used over and over without giving off residue, and will not stain or leave material embedded within the fabric after processing. Referring to FIG. 1B, the article 10 of FIG. 1A is shown in cross-section to illustrate the hollow interior 18 of the article.

Referring to FIG. 2, an alternative embodiment of an article for distress-washing fabric is shown at reference numeral 20. As in the previous embodiment, article 20 is generally spherically shaped and includes a hollow ball portion 22 that is sealed and contains a volume of air sufficient to overcome cause the article to float in the machine. The article 20 further defines a plurality of distressing features, specifically projections 24, arranged either randomly or in a predetermined pattern on its outer surface. The projections may be any number, size and shape, and project any distance from the surface of the ball 22. The projections may be formed by molding, attachment to the ball 22 or by securing substantially identical halves around a ball portion 22. The projections are operable for distressing and/or softening the fabric upon impact during processing.

Figure 2A:
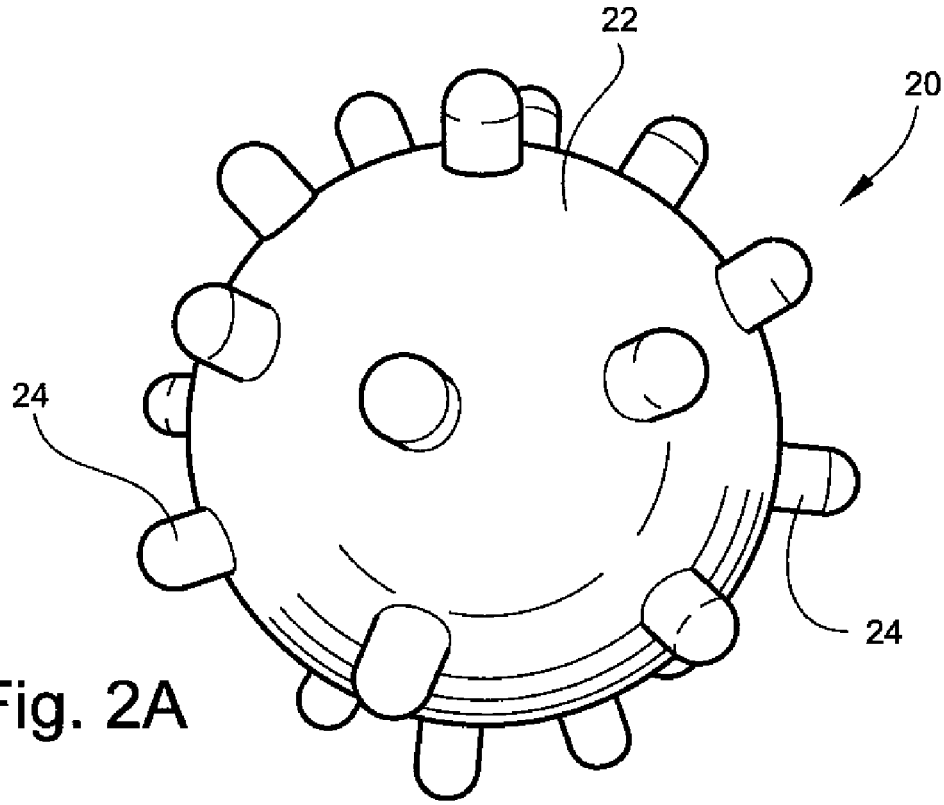
FIGS. 2A and 2B are perspective and cross-sectional views, respectively, of an article including at least one projection defined on its outer surface.
Figure 2B:
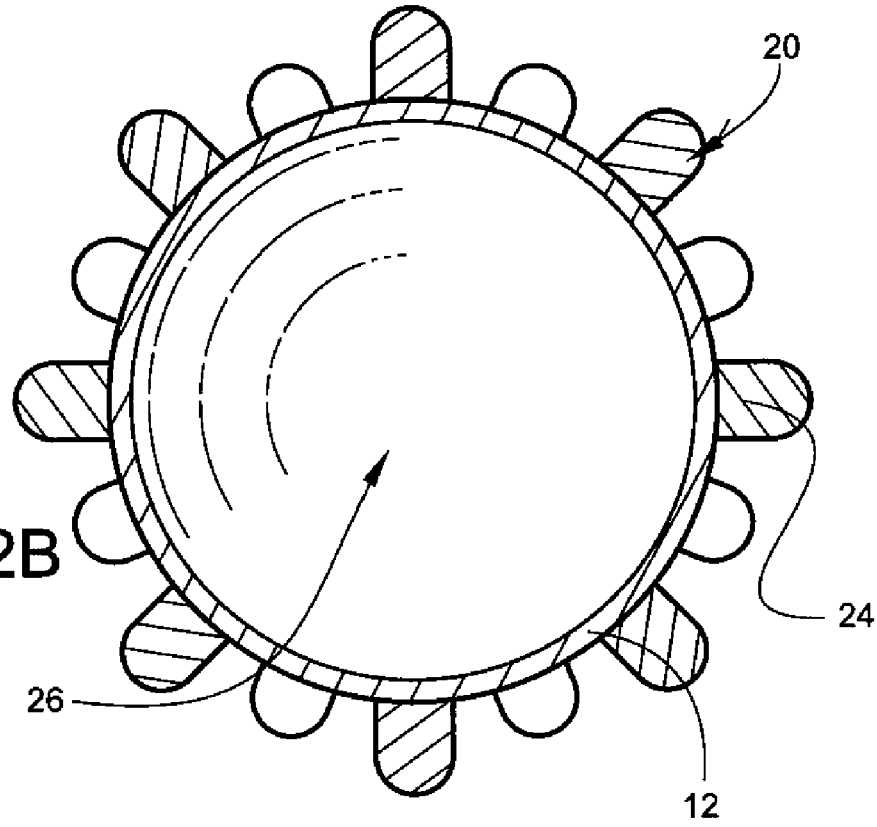

As in the previous embodiment, the article may range in diameter from about less than one centimeter to about more than 8 cm, preferably about 5 cm. The article 20 may be constructed from about 18-20 gauge stainless steel. In an alternative embodiment, the article is ceramic or includes a ceramic coating and the projections are formed by etching the ceramic surface. Referring to FIG. 2B, the article 20 of FIG. 2A is shown in cross-section to illustrate the hollow interior 16 of the article.

Referring to FIG. 3, an alternative embodiment of an article for distress-washing fabric is shown at reference numeral 30. As in the previous embodiments, article 30 is generally spherically shaped and includes a hollow ball portion 32 that is sealed and contains a volume of air sufficient to cause the article to float in the machine. The article 30 further defines at least one, and preferably a plurality of distressing features, specifically ridges 44, arranged either randomly or in a predetermined pattern on its outer surface. The ridge may be any number, width, length and shape, and project any distance from the surface of the ball 32. The ridges may be formed by molding, casting, stamping, attachment to the ball or by etching or milling away portions of the outer surface to create the ridges. The ridges are operable for distressing and/or softening the fabric upon impact during processing.

Figure 3A:
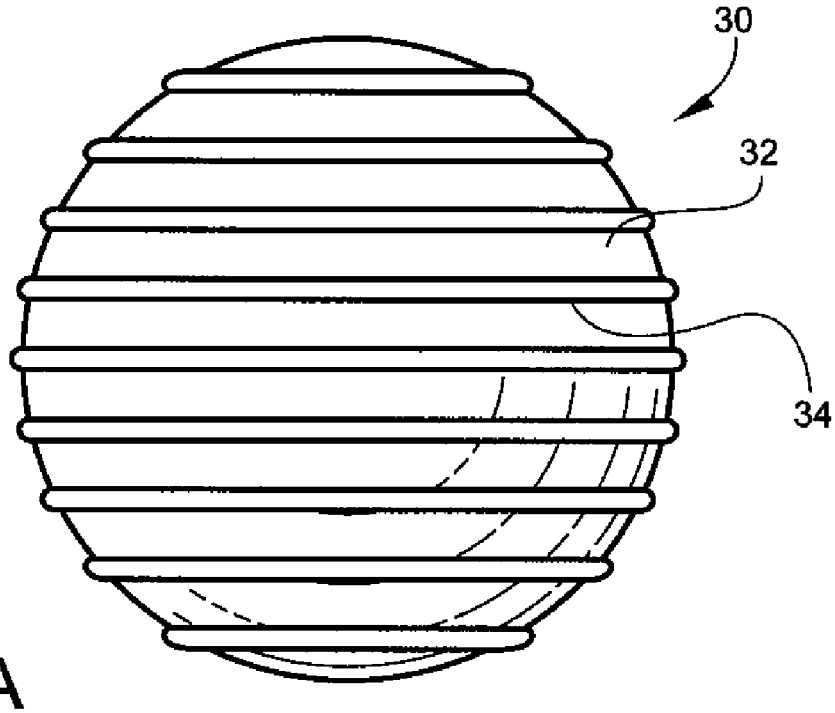
FIGS. 3A and 3B are perspective and cross-sectional views of an article defining at least one ridge on its outer surface.
Figure 3B:
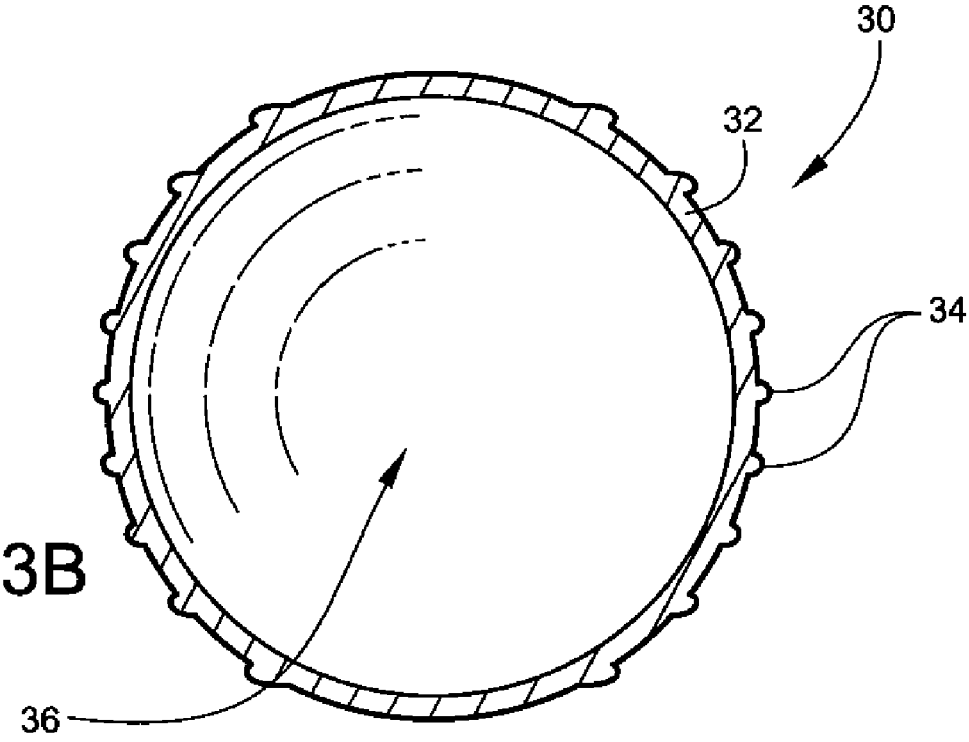

As in the previous embodiments, the article may range in diameter from about less than one centimeter to about more than 8 cm, preferably about 5 cm. The article 20 may be constructed from about 18-20 gauge stainless steel. In an alternative embodiment, the article is ceramic or includes a ceramic coating and the ridges are formed by etching the ceramic surface. Referring to FIG. 3B, the article 30 of FIG. 3A is shown in cross-section to illustrate the hollow interior 36 of the article.

A method of distress-washing fabric includes the following steps, where several of the steps may be performed in no particular order: (1) providing an industrial washing machine adapted to distress wash fabric; (2) loading the machine with at least one fabric article to be distressed; (3) filling the machine with a predetermined amount of water; (4) optionally adding in predetermined distressing agents and dyes; (5) providing at least one article for distressing the fabric; (6) loading the at least one article into the machine; (7) running the machine for a predetermined period of time, and a predetermined temperature, speed and cycle; (8) draining the water, and; (9) removing the fabric.

Another method of distress washing fabric includes the steps of: (a) providing an industrial washing machine, a fabric and at least one article for distress-washing fabric; (b) loading the machine with the fabric, the at least one article and water; and (c) tumbling the fabric and the at least one article at a predetermined speed and for a predetermined time such that the at least one article impacts the fabric and distresses the fabric.

Figure 4:
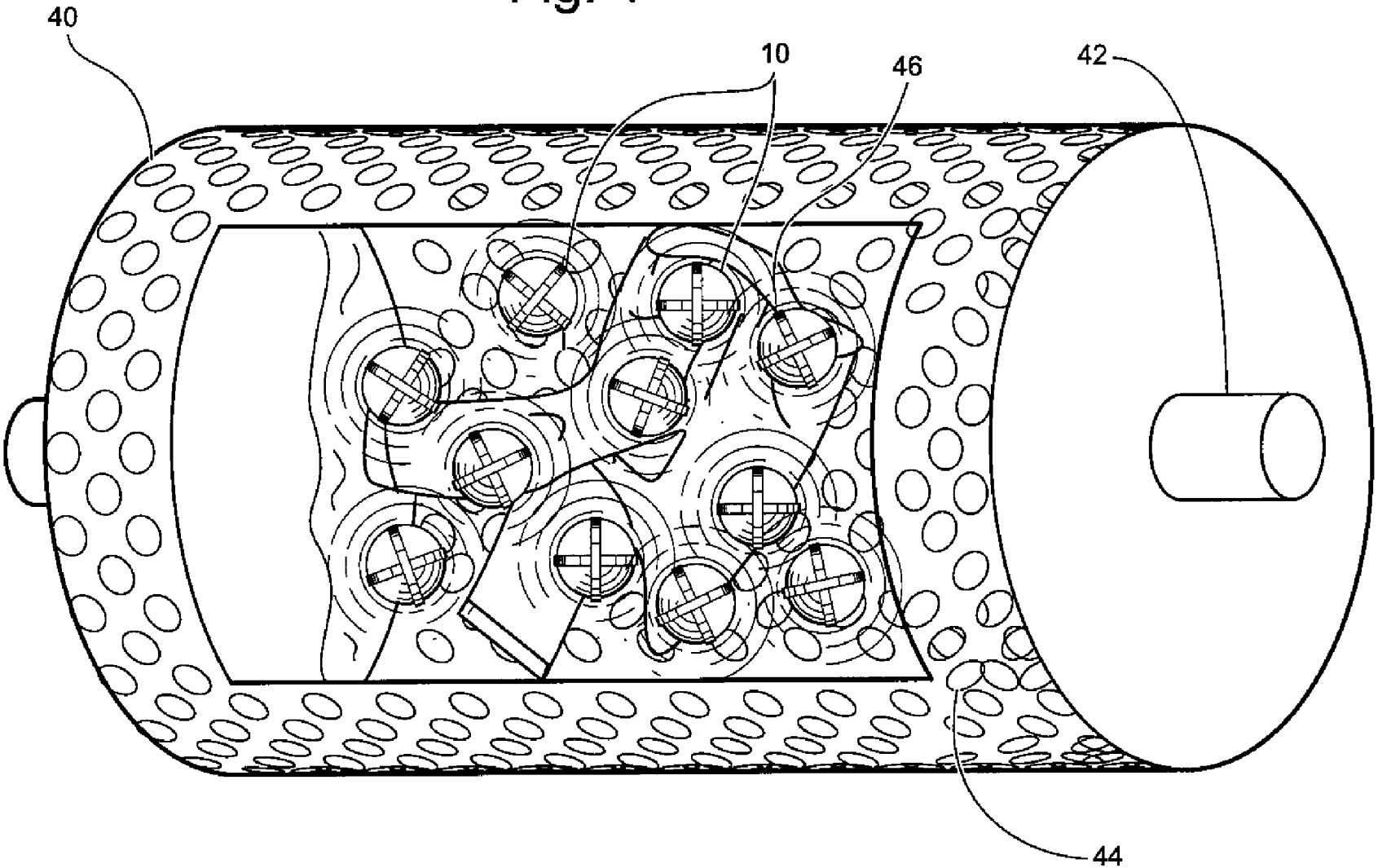
FIG. 4 is a perspective view of an industrial washer loaded with fabric and a plurality of articles shown in FIG. 1 for distress-washing the fabric.

Referring to FIG. 4, the method may be practiced in an industrial washing machine utilizing at least one fabric article and at least one article for distress washing. For example, about 600 articles may be added to a load of about 10 garments to achieve a desired result. The process may be scaled up, for example, about 5000-6000 articles may be used to distress-wash a load of about 100 garments. As stated above, garments may be made from any fabric or combination of fabrics that lends itself to a distress-washing process, such as denim. As shown, the washing machine includes a drum 40 that rotates about a horizontal axis 42. An article to be distress washed 46 is tumbled with at least one distress washing article 10, 20, 30 or combinations thereof, in a predetermined volume of water for a predetermined period of time to achieve a desired effect.

The articles described herein are advantageous over prior art distress-washing articles. In particular, the articles described herein provide more even wear, do not produce grit and residue during processing that embeds itself within the fabric and machine and must be removed, do not affect the color of the fabric, are reusable and are environmentally friendly. Thus, the materials described herein and articles made therefrom are substantially wear-resistant and do not produce residue during the distressing process. Additionally, articles may be manufactured having any combination of the above described rings, projections and ridges, among other features.

The foregoing is a description of articles for distress-washing fabric. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

What is claimed is:

1. An article for distress-washing fabric, comprising:

a spherical hollow float; and a cage confining the spherical hollow float and disconnected therefrom such that the float is able to rotate within the cage, the cage including at least two intersecting bands confining the float and secured together at their points of intersection;

wherein the article is substantially wear resistant and does not produce residue as a result of impact with fabric, internal surfaces of a washing machine and additional articles for distress-washing fabric.

2. An article according to claim 1, wherein the article is made from stainless steel.

3. An article according to claim 2, wherein the stainless is steel is from about 18 to about 20 gauge stainless steel.

4. An article according to claim 1, wherein the outer surface of the float is etched ceramic.

5. An article according to claim 1, the article comprising first and second perpendicularly intersecting bands confining the float and secured together at their points of intersection.

6. A method for distress-washing fabric comprising the steps of:

(a) providing an industrial washing machine, a fabric and at least one article for distress-washing the fabric, the article comprising a spherical hollow float confined within a cage and disconnected therefrom such that the float is able to rotate within the cage, the cage including at least two intersecting bands confining the float and secured together at their points of intersection;

(b) loading the machine with the fabric, the at least one article and water; and (c) tumbling the fabric and the at least one article at a predetermined speed and for a predetermined time such that the at least one article impacts the fabric to distress the fabric.

7. A method according to claim 6, the article comprising first and second perpendicualrly intersecting bands confining the float and secured together at their points of intersection.

* * * * *